United States Patent [19]

Anderson

[11] 4,155,219

[45] May 22, 1979

[54] WRIST WATCH PROTECTOR

[76] Inventor: Gordon W. Anderson, 905 Canosa, Las Vegas, Nev. 89104

[21] Appl. No.: 815,950

[22] Filed: Jul. 15, 1977

[51] Int. Cl.[2] ..... A44C 5/18; G04B/43/00

[52] U.S. Cl. ..... 58/105; 224/168

[58] Field of Search ..... 58/105; 224/4 D, 4 E, 4 F

[56] References Cited

U.S. PATENT DOCUMENTS

| | | | |
|---|---|---|---|
| 2,998,695 | 9/1961 | Cornett | 58/105 |
| 3,747,171 | 7/1973 | Montague, Jr. | 224/4 E X |

FOREIGN PATENT DOCUMENTS

| | | | |
|---|---|---|---|
| 8605 of | 1915 | United Kingdom | 224/4 D |

*Primary Examiner*—Stanley J. Witkowski

*Attorney, Agent, or Firm*—Seiler & Quirk

[57] ABSTRACT

A wrist watch protector comprises a flexible wrist encircling band for covering the watch with a centrally located opening for viewing the face of the watch. A quick-opening flap secured to the top of the wrist band covers the watch crystal. Utilization of a watch-carrying band strap located between the band and the flap allows the protector to optionally serve as a watch band by threading the strap through the bracelet attaching pins carried by the watch body.

4 Claims, 4 Drawing Figures

WRIST WATCH PROTECTOR

BACKGROUND OF THE INVENTION

In recent years wrist watches have come to be recognized more as articles of jewelry than as time-pieces. People at all economic levels own wrist watches of original artistic designs which often contain precious metal or precious stones. Frequently a wrist watch is the only piece of jewelry which a man will wear, and often is the subject of great pride of the owner.

Many people engage in activities where damage to a wrist watch may occur. Carpenters, plumbers, painters, iron workers, welders, and others working in a building trade constantly expose their wrist watches to abrasion and blows. Construction and factory workers may also be exposed to acid, alkali or other chemicals which can damage the metal finish or etch away the glass or plastic crystal. Fumes or excess moisture can easily penetrate the watch casing and corrode or otherwise deleteriously effect the inner working of the watch. Even people who do not have physically active jobs frequently expose their watches to damage when working around the house. The risks of damage to expensive watches are well known, and many attempts have been made in the past to protect watches from these damages. In general, wrist watch protectors have fallen into two types; a first variety of cuff-type wraparound protector which simply fits over the watch on the wrist, and a second tube-type protector into which the watch is placed, with the whole assembly placed on the wrist. Representative of the first variety are the wraparound devices of Williams, U.S. Pat. Nos. 2,249,550, Dressen, U.S. 2,344,136 and Karpf, U.S. 1,857,195. These devices are generally slip-on covers which seal the watch against intrusions of water and dirt. Hucknall, U.S. Pat. No. 2,584,270 shows a combination of a wrap around elastic bracelet with a hard plastic shield through which the face of the watch can be seen. Holder, U.S. Pat. No. 2,553,089 also discloses a wraparound bracelet having a transparent face through which the watch can be seen; the bracelet itself is somewhat decorative as well as protective.

Protective devices which completely enclose the watch may cover the total of the watch or only a portion thereof. For example, Schreiber, U.S. Pat. No. 1,767,315 discloses a protective cover which buckles around the face of the watch leaving the strap intact. A device which encloses the face and a portion of the band is shown in Vedder, U.S. Pat. No. 2,182,830. Tubular devices where the watch is completely enclosed in the protective cover prior to placing on the wrist of the wearer are shown in Bradbury, U.S. Pat. Nos. 2,076,221 and Friedman, U.S. 2,227,131. Another type of protector is shown in Cornett, U.S. Pat. No. 2,998,695 which discloses a wide band which is placed on the wrist of the wearer before the watch is put in place. After placing the watch on his wrist, the wearer then rolls side flaps which exist on the band over the top of the watch, attaching the flaps together with snaps and forming a protective cover.

Still other protective coverings have required removal of the watch band components from the wrist watch and placing the remaining watch body in a special carrier which can be carried in the user's pocket. For example, Fenyvessy, U.S. Pat. No. 2,511,105 discloses a stitched leather protective pouch which may be inserted or pinned to the pocket of the user. Parris, U.S. Pat. No. 3,552,117 shows a similar device in which the watch is suspended by a quick release strap.

While each of the described devices of the prior art serves the purpose for which it was intended, none of the watch protectors provides a multipurpose protector which can be used either with an existing watchband or in place of an existing watch band. It is an object of the invention to provide such a protector and to provide a protector which can be easily and quickly put into place; and which is adjustable in size for all users and for all different size watches. It is a further object of the invention to provide a watch protector which is easily and inexpensively manufactured but which is attractive and easily decorated.

SUMMARY OF THE INVENTION

A wrist watch protector for applying to a wearer's wrist over a wrist watch comprises a flat flexible wrist encircling band having a inner surface adapted to cover the wrist watch fastening means carried by the band for adjustably fixing the band around the wearer's wrist, an opening centrally located in the band to allow the wearer to view the face of the watch, a flexible cover flap having one end thereof secured to the outer surface of the band, and an inner engaging fastening means attached to the lower surface of the second end of the cover flap and the upper surface of the band.

BRIEF DESCRIPTION OF THE DRAWINGS

The invention is better understood with reference to the drawings wherein.

DETAILED DESCRIPTION OF THE INVENTION

Figure 1:
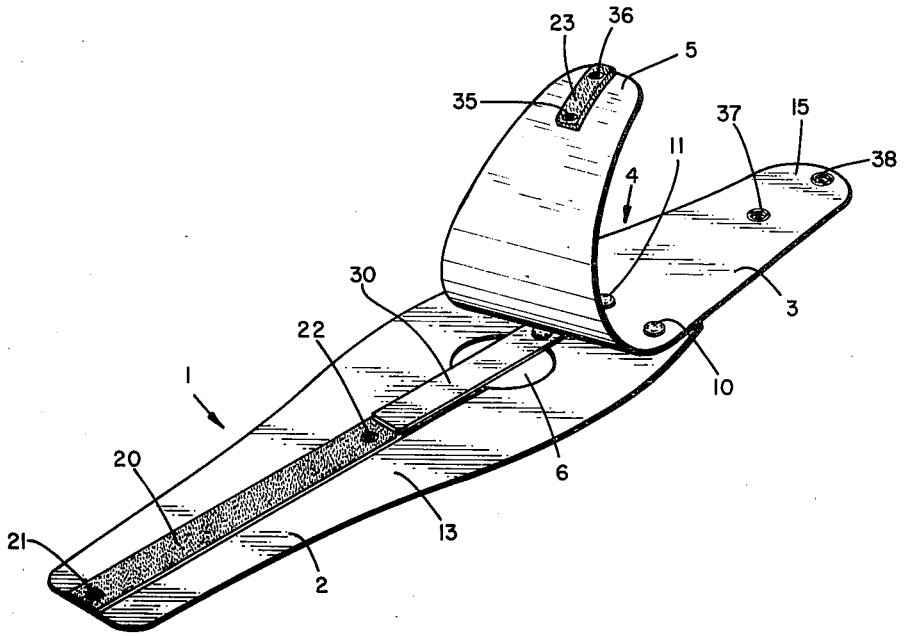
FIG. 1 is a perspective view of the watch protector of the invention with the watch cover flap shown in open position.

Referring to FIG. 1, wrist watch protector 1 has a wrist encircling band made from flexible leather material formed from lower member 2 and the rear portion 3 of upper member 4. The forward portion 5 of the upper member serves as a flap to cover the watch crystal which would extend through opening 6 in the lower member. The upper member is fastened to the lower member by studs 10, 11, and 12 which separate the forward from rear portions of the member. These studs are conventional fastening members which are applied by press fitting to the two members. Lower member 2 has an upper surface 13 and lower surface 14 whereas the upper flat member has an upper surface 15 and a lower surface 16. If desired, of course, the lower member could also comprise the rear portion of the upper member. In other words, the wrist encircling band would be one entire piece and upper flap 5 would be a separate piece commencing at the fastening members.

To enable rapid and convenient use by the wearer, the wrist band and flap are held in place by quickly releasable fastening members which may be snap fasteners or other male-female type connectors, but are preferably of the Velcro® type fasteners. Velcro type fasteners which are available in tape or strip form comprise lengths of materials of two types, the first having a plurality of small hooks which project from the surface and the second incorporating a surface of small fiber loops for engaging the hook elements. When the hook elements are pressed against the fiber loops, the hooks engage the loops and the two tapes become securely fastened, but are easily released with a strong pull. The Velcro type fasteners are readily available and well known and are produced and described in a number of U.S. Patents, for example U.S. Pat. Nos. 2,217,432, 3,114,951, 3,009,235 3,130,111, 3,076,244, and 3,083,737.

Figure 4:
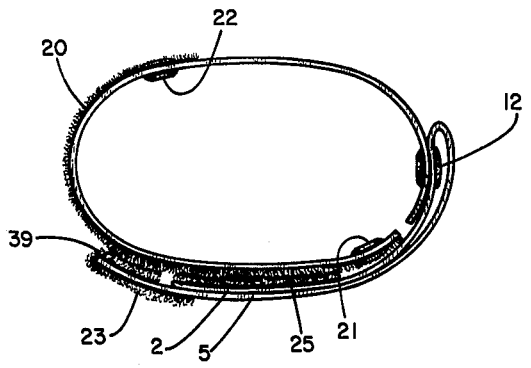
FIG. 4 is a side view of the protector showing its use with the face cover in retracted position.

The interengaging fastening means used in several instances in the invention are Velcro tape strips appropriately placed on the protector. Strip 20 is a Velcro strip of hooks fastened lengthwise on the upper surface of the lower strap. This strip is attached by studs 21 and 22 and by an adhesive backing which secures the strip to the strip surface. Three separate sections of Velcro strips comprising loops engage with the hook strip, namely, strip 23 located on the underside of the watch protecting flap, strip 24 located on the underside of the watch body mounting strap 30 (see FIG. 2) and strip 25 which is located on the underside of member 3 and which is used to fasten the whole unit to the wrist. In a preferred but optional mode of the invention, strip 23 extends around the end of flap 5 to the upper side of the flap, forming Velcro surface 39. In the event that the wearer wishes to have the flap held in its removed or retracted position, he can wind the flap backwards around his wrist and engage hook surface 39 with the end of loop surface 20 (See FIG. 4). This is a particularly useful feature for nurses, who wear the flap in protective position most of the time, but frequently need to see the watch and also have the use of both hands (e.g. when checking pulse or breathing rates).

In addition to the adhesive backing on each section of Velcro strip, section 23 is held by stud fittings 35 and 36 and section 25 is held by stud fittings 37 and 38 for extra strength.

Figure 2:
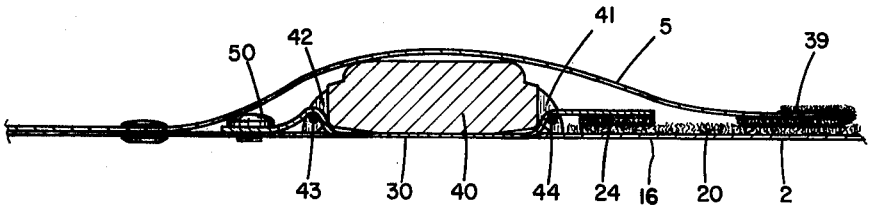
FIG. 2 is a partial side section view of the device showing its use as a watch band as well as a protector with a watch body in place.
Figure 3:
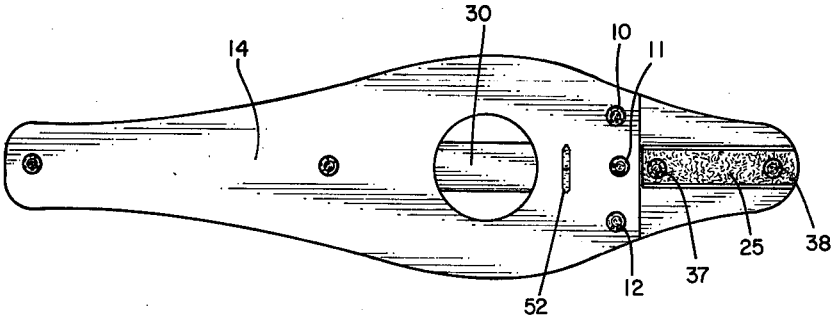
FIG. 3 is a bottom view of the watch protector.

A particularly useful feature of the watch protector of the invention is its ability to adapt to serve as a wrist watch band. FIG. 2 shows a section of a watch on which the normal watch band has been removed and which is mounted in the watch protector by means of the watch body mounting strap 30. Watch body 40 has lugs 41 and 42 which in cooperation with similar lugs located on the other side of the watch (not shown because of the section view), support the band-carrying pins 43 and 44. After the normal watch band is removed and pins 43 and 44 replaced on the watch body, strap 30 is threaded through the pins and underneath the watch body and then is attached to the lower strap member 2 by pressing Velcro strip 24 against Velcro strip member 20. Strap 30 is removably attached to strap 2 by staple pin member 50 which is inserted through holes (not shown) in strap 30 and strap 2; subsequently the flexible metal arm members 51 and 52 are bent upwardly against the bottom surface 14 as shown in FIG. 3 to hold the strap in place. In the event that the strap is not needed, and the device is to be used solely as a watch protector, strap 30 can easily be removed simply by removing pin 50.

Use of the watch protector of the invention is very simple. If the device is to be used only as a watch protector, it is placed over the watch while the watch is being worn by the wearer and opening 6 is centered over the watch face. The user then wraps strap members 2 and 3 around the wrist until a snug fit is obtained and then presses Velcro strips 25 and 20 together. The longitudinal placement of the strips on the strap members allows one size of watch protector to fit all users. The watch crystal is covered by pressing Velcro strip 23 on flap cover 5 into the hook carrying strip 20. Longitudinal placement of this strip also assures that the device will be adaptable to watches of all sizes. When the user wants to see the watch face he simply peels back strip 5, makes his observation and replaces the strip. If a worker determines that it will be necessary for him to use the watch protector for a long time, he may wish to use the watch protector as a watch band, thereby obviating the use of two separate devices. In this case he removes the regular watch band from the watch by removing the pins which carry the band, removes the bands from the pins, and replaces the pins in the lugs as shown. He then threads the watch body retaining strap 30 through the pins and attaches the interengaging Velcro strips 24 and 20. The device is then used as described above. Mounting strap 30 can easily be replaced or removed depending on the intended usage of the watch protector.

The strap portions of the band are preferably made from a soft, pliable material such a leather or plastic. The upper surfaces may be of any decorative color, or may have various patterns engraved or printed thereon for aesthetic purposes.

While a specific mode of the invention has been described in detail, many modifications will of course be obvious to one skilled in the art and the scope of the invention should not be imited by the specific description, rather the invention should be considered limited only by the scope of the following claims.

I claim:

1. A wrist watch protector for applying to a wearer's wrist over a wrist watch comprising a flat flexible wrist-encircling band having an inner surface adapted to cover a wrist watch and an outer surface, fastening means carried by the band for fixing the band around the wearer's wrist, an opening centrally located in the band to allow the wearer to view the face of the watch, a flexible cover flap having upper and lower surfaces, and having a first end thereof secured to the outer surface of the band, interengaging fastening means attached to the lower surface of the second end of the cover flap and the outer surface of the band, and mounting means for removably attaching a watch body to the protector.

2. The wrist watch protector of claim 1 wherein the mounting means comprises a relatively narrow flexible strap having one end thereof removably attached to the wrist encircling band and having a second end, said second end carrying removable fastening means for attaching the strap to the upper surface of the wrist encircling band.

3. The wrist watch protector of claim 1 also comprising interengaging fastening means secured to the upper surface of the cover flaps and to the upper surface of the band such that said interengaging fastening means are engaged when the flap is in a fully retracted position.

4. The wrist watch protector of claim 1 wherein the interengaging fastening means comprise one member having a plurality of flexible hooks and one member comprising loops for engaging the hooks.

* * * * *